United States Patent [19]

Shapiro

[11] Patent Number: 5,007,502

[45] Date of Patent: Apr. 16, 1991

[54] SELF-LEVELING SAW HORSE

[75] Inventor: Alan F. Shapiro, 24A McClellan St., Amherst, Mass. 01002

[73] Assignees: Alan F. Shapiro, Amherst, Mass.; David Edwardson, New York, N.Y.

[21] Appl. No.: 552,826

[22] Filed: Jul. 16, 1990

[51] Int. Cl.[5] ..... B27B 21/00; B25H 1/06

[52] U.S. Cl. ..... 182/155; 182/151; 182/225; 182/181

[58] Field of Search ..... 182/155, 153, 181–185, 182/225, 151

[56] References Cited

U.S. PATENT DOCUMENTS

| | | | |
|---|---|---|---|
| 1,518,972 | 12/1924 | Eckert . | |
| 1,713,359 | 5/1929 | Thomas | 182/155 |
| 2,144,049 | 1/1939 | Forcier | 182/225 |
| 2,396,737 | 3/1946 | MaClaskey | 182/155 |
| 3,198,286 | 8/1965 | Wilson | 182/155 |
| 3,951,233 | 4/1976 | Meyers . | |
| 4,030,565 | 6/1977 | Chaput . | |
| 4,152,834 | 5/1979 | Stansberry . | |
| 4,325,463 | 4/1982 | Taylor . | |
| 4,403,678 | 9/1983 | Zieg . | |
| 4,605,099 | 8/1986 | Crum et al. . | |
| 4,640,386 | 2/1987 | Hall . | |
| 4,711,319 | 12/1987 | Sansotta et al. . | |
| 4,771,863 | 9/1988 | Stansberry . | |

*Primary Examiner*—Reinaldo P. Machado
*Attorney, Agent, or Firm*—Peter D. Aufrichtig

[57] ABSTRACT

A self-leveling foldable saw horse including a trestle formed as a downwardly opening box, two pairs of legs, each of which has three working surfaces for leveling the pairs of legs, stably supporting the weight on the trestle and enabling rotation of the legs from a closed position to an opened position and two rods for supporting the legs. The first operating surface on each leg of a pair of legs is in contact with the first operating surface of the other leg of its pair and the second surfaces of each leg of pair are in contact with the underside of the top surface of the trestle when the saw horse is in the open position. Exerting pressure on the top surface of the trestle causes sliding adjustment of the first operating surfaces of each pair to level the trestle and stably support the saw horse on uneven surfaces. Two saw horses can be attached together in a compact, efficient manner with handles to transport the pair of saw horses for use on uneven ground surfaces.

23 Claims, 4 Drawing Sheets

SELF-LEVELING SAW HORSE

BACKGROUND OF THE INVENTION

The invention is generally directed to a saw horse for use in construction and carpentry activities and in particular to a self-leveling and folding saw horse which is easily transportable in a folded position.

Saw horses are well known in the art for supporting work pieces of wood, metal, and other construction materials at a convenient height for working. Generally, two saw horses are used in unison to support a material between the two saw horses.

A saw horse generally includes a transverse member known as a cross bar or trestle which is supported by four legs attached to the corners of the cross bar. Traditional saw horses are large, heavy, bulky, and difficult to transport. In addition, they suffer from the need to be placed upon a flat surface to ensure the stability of the saw horses so that the material placed on the saw horse does not move while being worked on.

There have been various approaches to the composition of a folding or at least partially folding saw horse. See, for example, U.S. Pat. Nos. 3,951,233; 4,030,565; 4,152,834; 4,403,678; 4,325,463; 4,605,099; 4,640,386; 4,711,319; and 4,771,863, all of which are incorporated by reference herein.

Conventional saw horses are inconvenient and bulky to transport from working site to working site. The conventional saw horses are more appropriate in a fixed work shop, particularly one with a perfectly flat surface. Where the floor or ground is not level, the conventional saw horse with its fixed geometry tends to have at least one of the legs not touching the surface, thus creating an unstable and rocking support which is not conducive to the stable support intended to be provided by the saw horse. Collapsible or foldable saw horses of the various types described above and known in the prior art, were developed to aid in the movement of saw horses from work site to work site. However, many work sites do not have level surfaces and the saw horses do not provide a reliable, stable support surface for the work materials placed on them.

Accordingly, there is a need for a portable saw horse which will provide a stable, level support on a variety of level, near-level, and uneven surfaces.

SUMMARY OF THE INVENTION

The invention is generally directed to a saw horse including a trestle, two pairs of legs, and two bolts. The trestle includes a substantially flat surface for supporting weight and a downwardly opening box formed with two side walls extending substantially the entire length of the trestle and two end walls connecting the side walls. Two pairs of legs are adapted to rotate from a closed position in which each of the legs is contained within the box formed by the trestle and an open position where each of the legs is in a generally vertical orientation. Each of the legs has an enlarged opening proximate its upper end in the open position, a support surface at its lower end in the open position, and first, second, and third operating surfaces at its upper end in the open position. The first operating surfaces are adapted to level the pairs of legs. The second operating surfaces are for stably supporting the weights on the trestle. The third operating surfaces are for enabling the rotation of the legs about the enlarged opening from the closed position to the open position. Two bars, coupled between the side walls proximate each of the end walls extend through the openings in both legs of one of the pairs of legs. The first operating surfaces on each leg or pair of legs is in contact with the first operating surface of the other leg in the pair. The second surfaces of each leg or pair are in contact with the underside of the top surface when the saw horse is in the open position. The application of downward pressure on the top surface of the trestle causes sliding adjustment of the first operating surface of each pair to level each end of the trestle and stably support the sawhorse on varying degrees of uneven surfaces.

Accordingly, it is an object of the invention to provide an improved self-leveling saw horse.

Another object of the invention is to provide an improved collapsible self-leveling saw horse.

A further object of the invention is to provide a collapsible self-leveling saw horse which folds into a compact and portable unit.

Still another object of the invention is to provide a self-leveling collapsible saw horse assembly including two saw horses which fit together in a compact and portable fashion for easy transportation between work sites.

Still other objects and advantages of the invention will in part be obvious and will in part be apparent from the specification.

The invention, accordingly, comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
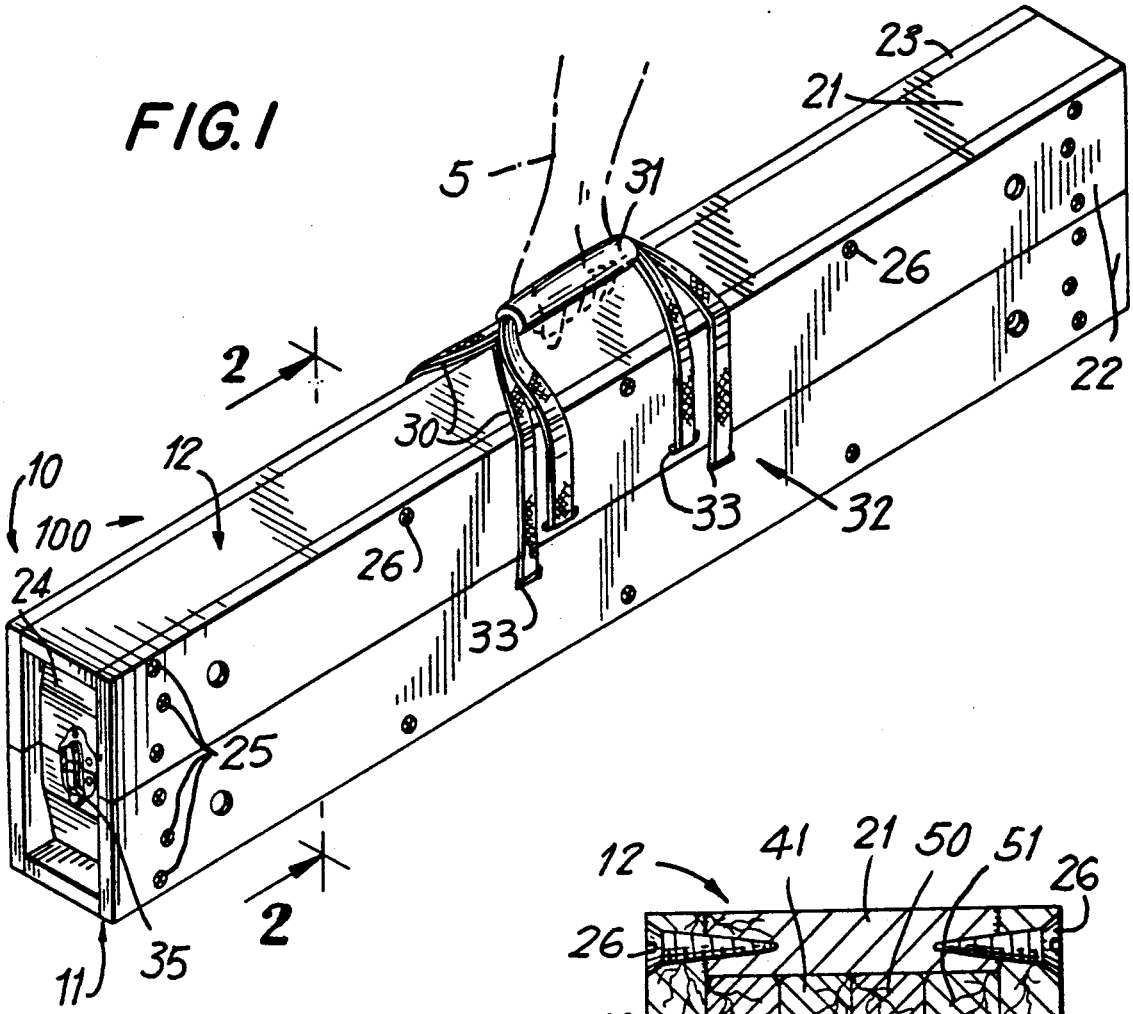
FIG. 1 is a perspective view of a two saw horse combination constructed in accordance with a preferred embodiment of the invention.

Reference is made to FIG. 1 wherein a saw horse assembly generally indicated as 100, in accordance with a preferred embodiment of the invention is depicted. Saw horse assembly 100 includes first saw horse 10 and second saw horse 11 joined together by an adhesive or with fasteners 35 found on both ends of saw horse assembly 100. Saw horse assembly 100 has straps 30 and grip 31 which encircles straps 30 to allow a hand 5 to grip and carry saw horse assembly 100. In a preferred embodiment the free ends of straps 30 extend through slots 33 and are folded over twice and then pulled tightly in slots 33. Straps 30 may be nylon tubing which is split in half.

Figure 2:
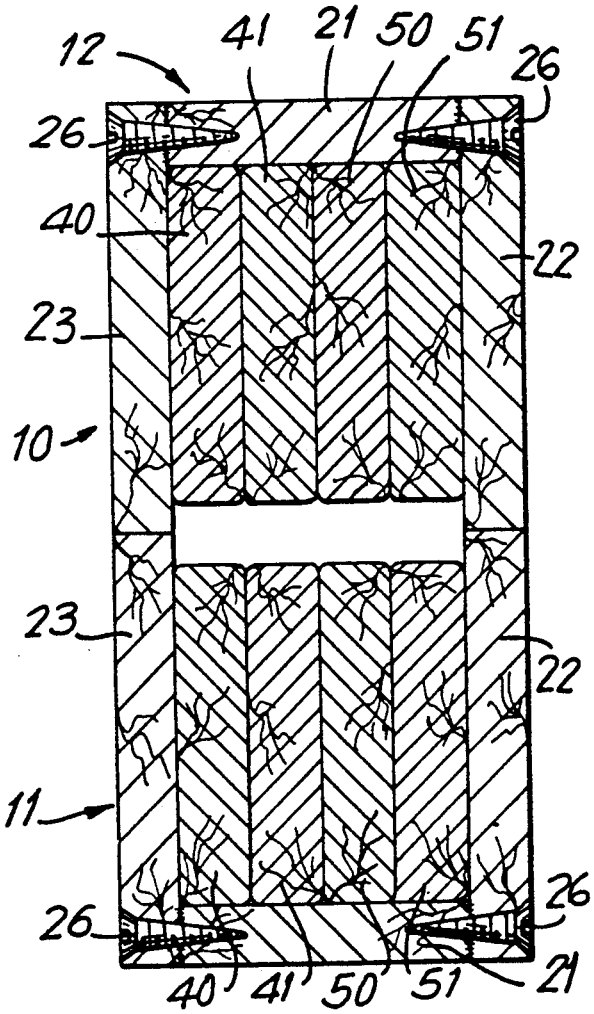
FIG. 2 is a cross-sectional view taken along line 2—2 of FIG. 1.
Figure 3:
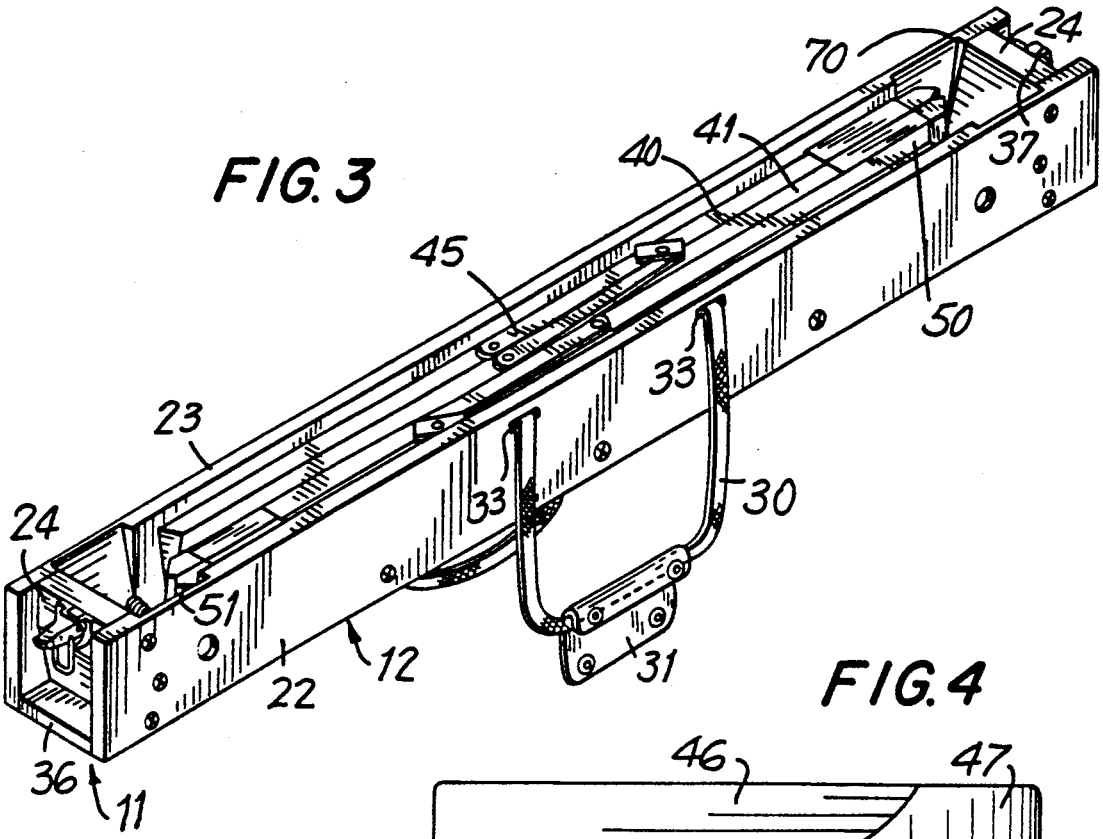
FIG. 3 is a perspective view of the lower saw horse member of the dual saw horse combination of FIG. 1.
Figure 4:
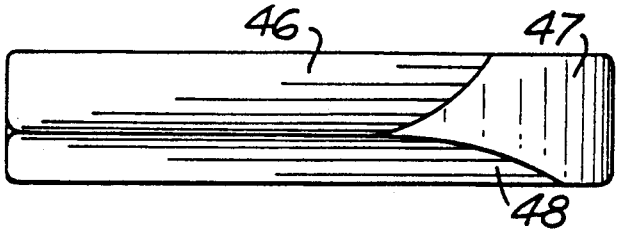
FIG. 4 is a top plan view of the working surfaces of a saw horse leg constructed in accordance with a preferred embodiment of the invention.
Figure 6:
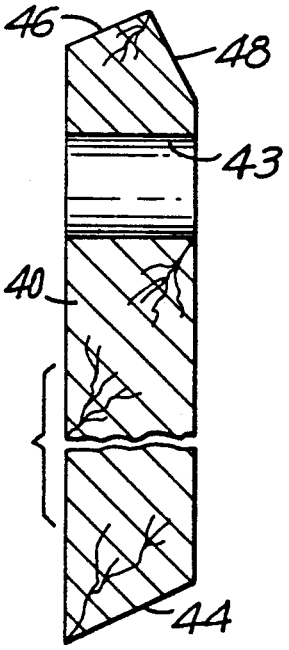
FIG. 6 is a cross-sectional view taken along line 6—6 of FIG. 5.
Figure 5:
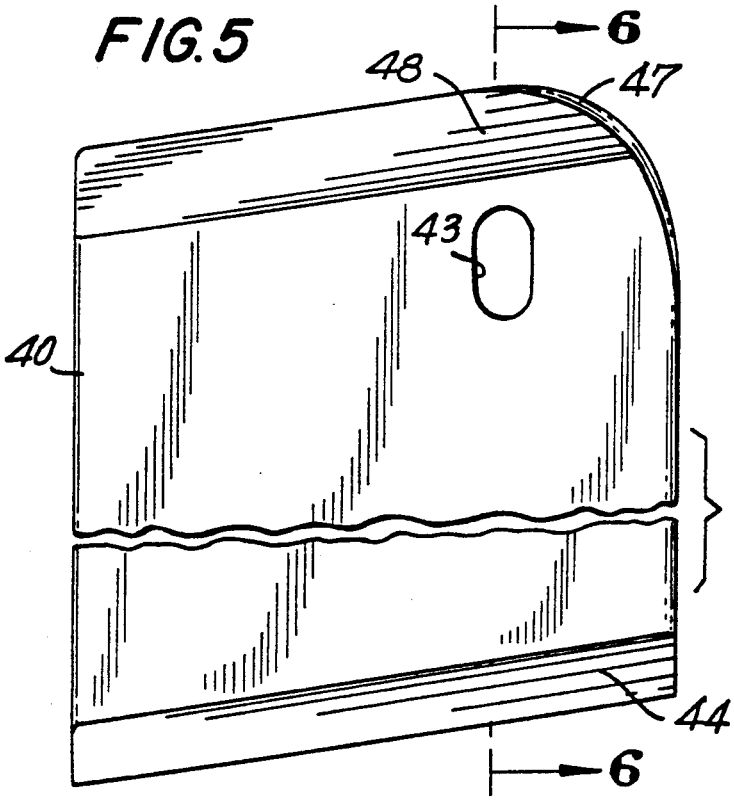
FIG. 5 a side elevational view of the saw horse leg of FIG. 4.

As seen in FIGS. 1, 2, and 3, each of saw horses 10 and 11 includes a trestle generally indicated as 12 including top member 21, side walls 22, 23, and end walls 24. Top member 21 and side walls 22 and 23 are securely fastened to each other with connectors 26. End walls 24 are coupled to side walls 22 and 23 with fasteners 25. In a preferred embodiment top member 21, side walls 22 and 23, and end walls 24 are formed of a hardwood or other sturdy wood and fasteners 25 and 26 are wood screws or other suitable sturdy wood fasteners.

Handles 30 are attached to the top surface of side walls 22 and 23 as shown in FIG. 3 with connectors 32. Straps 30 extend for a suitable length so that they may be gripped with handle 31 above the top of top surface 21 of saw horse 10 as shown in FIG. 1 enabling saw horse assembly 100 to be carried in a stable, narrow profile orientation.

Figure 11:
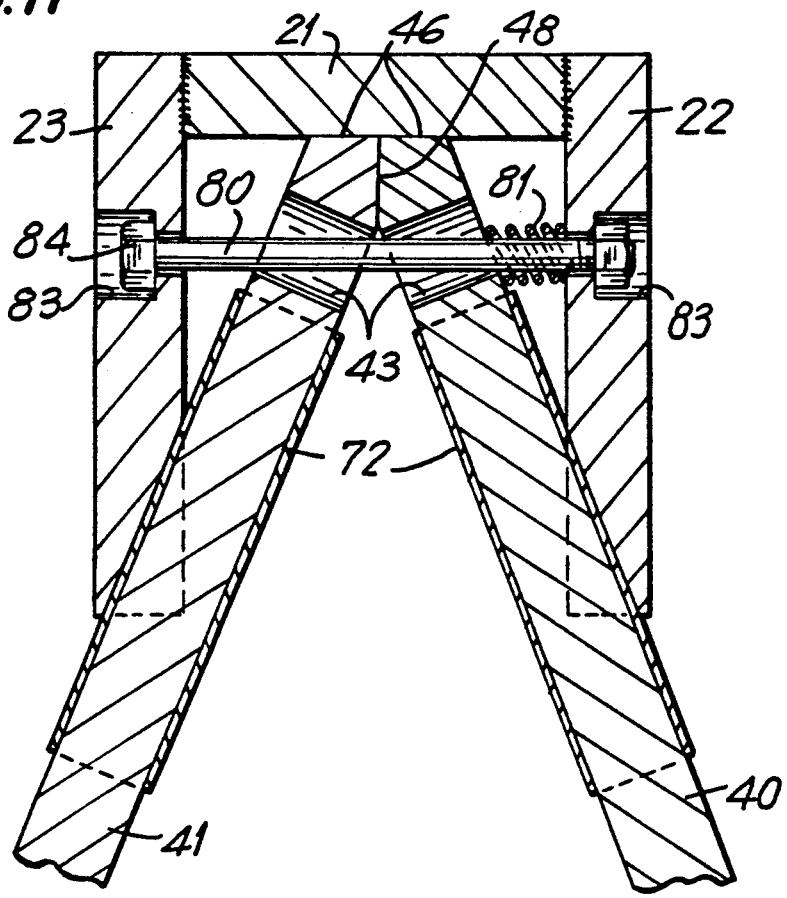
FIG. 11 is an enlarged cutaway cross-sectional view of the upper portions of a pair of legs in the saw horse of FIG. 8.
Figure 12:
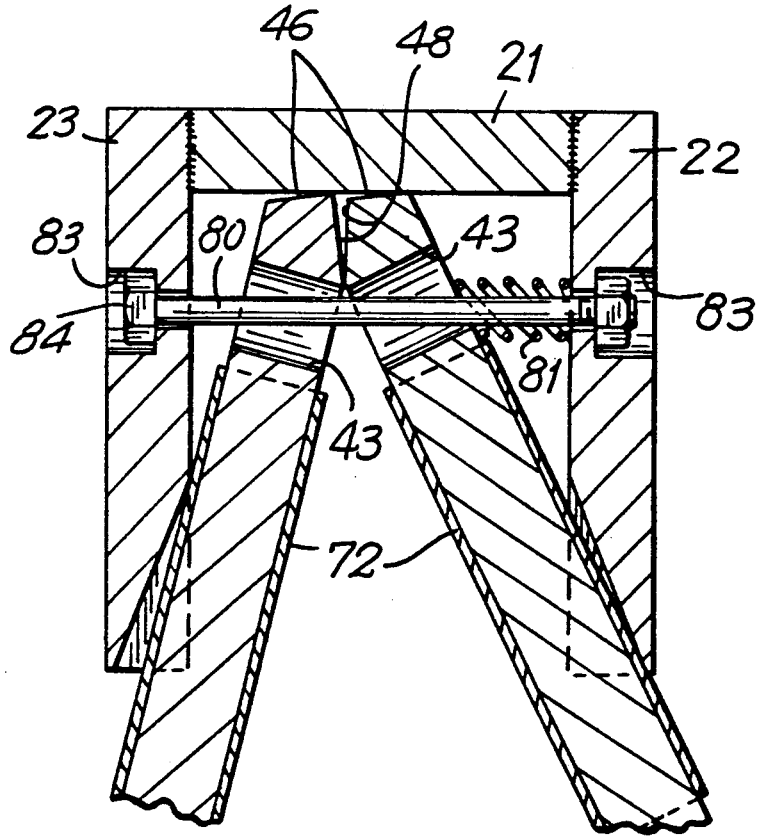
FIG. 12 is an enlarged partially cutaway cross-sectional view similar to the view of FIG. 11 of the saw horse of FIG. 10.

Saw horses 10 and 11 also include four legs, 40, 41, 50, 51 as seen in FIGS. 4–7. Legs 40, 41, 50, 51 each include an elongated oval hole or opening 43. Hole 43 may be formed by connecting two circular drilled holes to provide an elongated oval opening. In addition, each of legs, 40, 41, 50, 51 includes an angled base surface 44 for providing a stable support for the saw horses 10, 11 in their open position. Legs 40, 41, 50, 51 also have three working surfaces 46, 47, and 48 on the top of the leg. Surface 46 is angled so as to provide a relatively flat surface with the underside of top member 21 when the saw horse is in the open position as seen most clearly in FIGS. 11 and 12. Surface 47 is a curved surface which allows the legs 40, 41, 50, 51 to rotate easily from the closed position shown in FIG. 3 to the open position shown in FIG. 7. Working surface 48 is present on the side of legs 40, 41, 50, and 51 which face toward the other leg of each pair of legs. Legs 40 and 41 form one pair of legs and legs 50 and 51 form the second pair of legs. As shown best in FIGS. 11 and 12, working surfaces 48 on legs 40 and 41 face towards each other. Likewise, working surfaces 46 on each of legs 40 and 41 angle away from the point of connection between legs 40 and 41.

Legs 41 are protected near hole 43 and working surfaces 46, 47, 48 with a sheath 72. In a preferred embodiment, sheath 72 is a C-shaped piece of metal wrapped around the outside, side and a small portion of the inside of the leg 40, 41, 50, 51. The protective sheath 72 is adapted to fit into a flared box or mortise portion 70 formed in the side walls 22, 23 adjacent end walls 24. The mortise 70 shown in FIG. 3 is adapted to assure that the pairs of legs 40, 41 and 50, 51 remain fixed in their open position against rotational movement and that a desirable outward angle with respect to the vertical is maintained. Mortise 70 holds pairs of legs 40,41 and 50, 51 in a near vertical position while allowing the legs to slide laterally to accomplish the self-stabilizing function.

Figure 7:
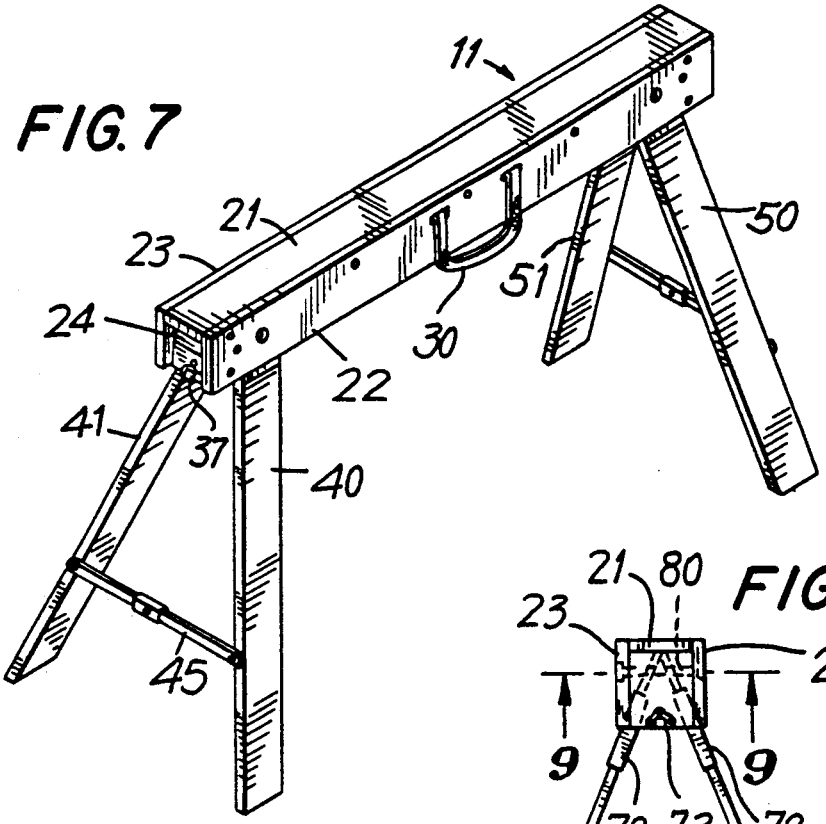
FIG. 7 is a perspective view of a self-leveling saw horse constructed in accordance with the invention in an open position.

Each pair of legs is connected by a folding, locking brace 45 which is connected on the sides of each of the legs to further stabilize the legs in their open position as shown in FIG. 7. Preferably brace 45 is about one third of the way up from the bottom of each leg 40,41,50,51.

Figure 9:
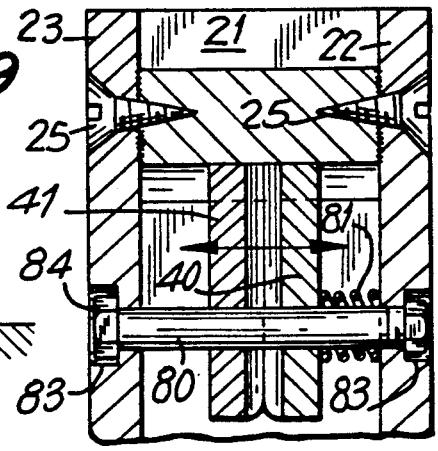
FIG. 9 is a cross-sectional view taken along line 9—9 of FIG. 8.

Each of the pairs of legs 40, 41 and 50, 51 is connected to trestle 12 by a bolt, bar or peg 80 extending from side wall 22 through openings 43 in each of the legs and finally extending into side wall 23. In a preferred embodiment, bolt 80 is set in depressions 83 in side walls 22, 23, and has a retaining nut 84 sunk in one of depressions 83 to securely fasten bolt 80 across the space between side walls 22 and 23. In a preferred embodiment, retaining nut 84 is a T-nut. In addition, each of bolts 80 in saw horse 11 has a spring 81 between one of walls 22 and 23 and the legs as shown in FIG. 9. Springs 84 cause one of the pairs of legs to be biased toward wall 22 and the other of the pairs of legs to be biased toward wall 23. In this way, both sets of legs can be easily fit into the open box formed by the underside of trestle 12 as shown in FIG. 3. Bullet catches may be utilized to retain the pairs of legs in the open box formed by the underside of trestle 12 when not in use.

Conventionally, two saw horses are utilized to support a work piece. Starting with saw horse assembly 100, a carpenter or other tradesman would carry saw horse assembly 100 with his arm 5 holding handle grip 31. As saw horse assembly 100 is brought to the appropriate work site, it would be placed down and connectors 35 including latch member 36 and post member 37 would be disengaged on both ends of saw horse assembly 100. Saw horses 10 and 11 would be separated and each would appear as shown in FIG. 3. Next, each of the pairs of legs 40, 41 and 50, 51 would be rotated out of the closed position in FIG. 3 until they reach mortises 70 where they would be pushed apart into a position as shown in FIG. 7. In the spread out position, legs 40 and 41 would be locked within mortise 70 and secured apart by strut 45. In a preferred embodiment, legs 40 and 41 are rotated out beyond the vertical so that they extend at an angle away from legs 50, 51. This splaying, which is also found in legs 50, 51, aids in the stability of saw horse 11 along the direction of top member 21. The outward or splaying angle with the vertical made by legs 40, 41 and 50, 51 is preferably 5–15 degrees, more preferably 8–10 degrees, and even more preferably 9 degrees. These angles allow the saw horses to be stacked on top of each other because the leg braces clear the ends of the saw horse being stacked upon. In addition, these angles limit the hazard of tripping over the legs because the legs do not stick out much further than the trestle or trestle 12 and good end-to-end tipping stability is provided.

The pairs of legs 40, 41 and 50, 51 are spread apart at an angle which provides stability perpendicular to and in the plane of top member 21. The angle between each saw horse leg and vertical is 15–40 degrees, more preferably 20–25 degrees, and even more preferably 21 degrees. As the angle increases so does the stability of the saw horse. However, the increase in angle tends to reduce the load bearing capacity of the legs due to the variation in arrangement of working surfaces 46, 47 and 48 caused by variations in angle. The angle varies in operation as the saw horse levels itself on different uneven surfaces.

When saw horse 11 is in the open position shown in FIG. 7, it is able to adjust to varying types of surfaces. The adjustment leaves trestle 12 level regardless of the unevenness of the base surface.

Figure 8:
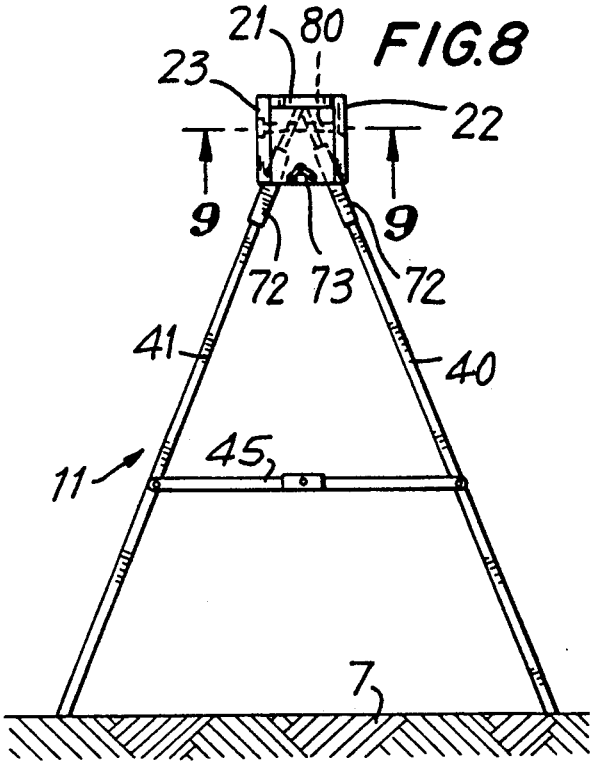
FIG. 8 is a side elevational view of the saw horse of FIG. 7 with the end surfaces within the trestle shown as transparent.
Figure 10:
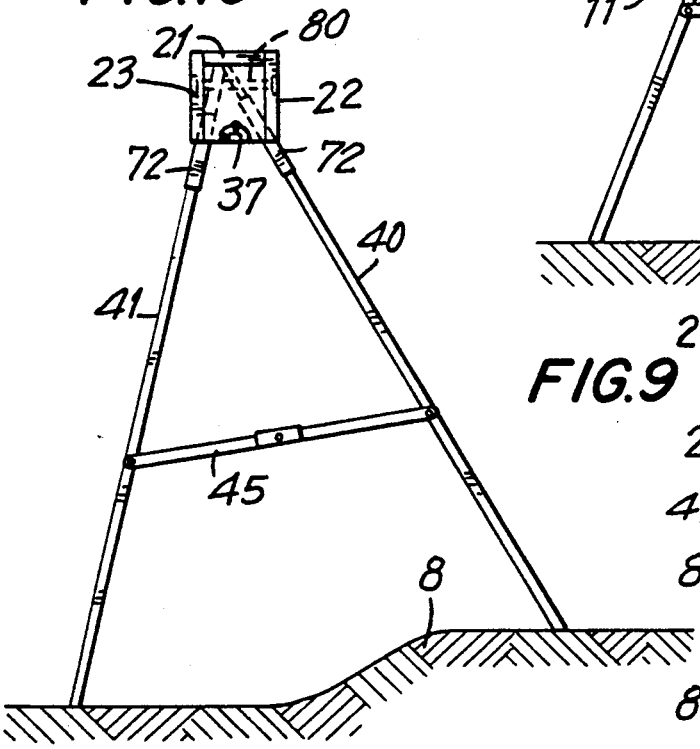
FIG. 10 is a side elevational view similar to the view of FIG. 8 wherein the saw horse is placed on an uneven surface.

Reference is next made to FIG. 8 where saw horse 11 is shown on a level surface 7. After saw horse 8 is placed on level surface 7, the user presses downward on the top of top surface 11. This causes working surfaces 48 to move relative to each other as shown in enlarged FIG. 11 and making upper member 21 a stable flat support. When saw horse 11 is moved to an uneven surface 8, the saw horse is again placed on surface 8 and a downward force is exerted on trestle member 21. The downward pressure causes working surfaces 48 to slide relative to each other to a new equilibrium point which adjusts the relative angle of legs 40 and 41 and again results in a substantially flat upper member 21.

The relationship of the sizes of bolt 80, hole 43 and the angle between the pairs of legs 40, 41, and 50, 51 enables leveling of saw horse 11 within reasonably expected site conditions. In a preferred embodiment the saw horse 11 will self level with variations from level of 10 degrees across each end, or pair of legs, or a 20 degree total deviation from the level conditions across both pairs of legs. The relationship described above can be varied. A different left leg angle with the same bolt location would require a larger hole 43 in the legs 40, 41, 50, 51 which would allow substantial play in the leg assemblies but interfere with the folding feature. The ends of the legs would hit the bolts of the opposite pair of legs unless the legs were made unusually short or the trestle unusually long. A different bolt location closer to the center of the leg and/or the center of trestle 12 would require severe rounding over the top of the leg to allow it to pivot which would take away from the weight bearing capacity of the legs. In addition, it would require a larger hole in the leg with the problems noted above.

As a result of the self-leveling feature present in each of the pairs of legs, the saw horse may be used to balance stably upon an uneven surface which has different degrees and types of unevenness at each of the pairs of legs.

When the user is finished with the saw horse, it can be easily folded up and returned to the closed position found in FIGS. 1 and 3. First, the user would release the locking member on strut 45. Next, the pairs of legs would be rotated together. Biasing springs 81 would push one pair of legs toward one side wall and the other pair of legs toward the other side wall. Then the legs are rotated into the open box formed by the underside of trestle or cross bar 12 so that all of the components are enclosed. Then if two saw horses have been utilized, the two closed saw horses can be reassembled and latched together to saw horse assembly 100 as shown in FIG. 1.

The saw horse 11 may be utilized alone without a second saw horse for situations where only one additional support is needed. The self-leveling feature is particularly useful in such situations where the need for stability and strength of the support is essential. The handles as shown may be utilized in the single saw horse arrangement or may be placed in different locations in accordance with conventional means to carry the saw horse.

The saw horse is constructed of wood in a preferred embodiment due to the favorable material characteristics of wood and the ease of working with these materials. However, the saw horse may be manufactured of metal, plastic, hybrid or varying material dependent upon the particular needs of the user.

In addition, the opening 43 can be enforced with a band made of metal or some other sturdy material to extend the useful work life of the saw horse.

Accordingly, an improved self-leveling, collapsible, and easily transportable saw horse which is stable on varying and uneven surfaces is provided.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A saw horse, comprising:

a trestle, including a substantially flat surface for supporting weight and a downwardly opening box formed with two side walls, running substantially the entire length of the trestle and two end walls connecting the side walls;

two pairs of legs adapted to rotate from a closed position in which each of the legs is contained within the box formed by the trestle and an open position where each of the legs is in a generally vertical orientation, each leg having an enlarged opening proximate its upper end in the open position, a support surface at its lower end in the open position and first, second and third working surfaces for leveling the pairs of legs, stably supporting weight on the trestle and enabling rotation of the legs about the enlarged opening from the closed position to the open position and vice versa, respectively;

a first rod coupled between the side walls proximate a first end wall and extending through the openings in both legs forming one of the pairs of the legs; and a second rod coupled between the side walls proximate the second end wall and extending through the openings in both legs forming the second of the pairs of legs;

the first operating surface on each leg of a pair of legs being in contact with the first operating surface of the other leg of its pair and the second surfaces of each leg of a pair being in contact with the underside of the top surface of the trestle when the sawhorse is in the open position;

whereby exerting pressure on the top surface of the trestle causes sliding adjustment of the first operating surfaces of each pair to level the trestle and stably support the saw horse on uneven surfaces.

2. The saw horse of claim 1 wherein the side walls and end walls are coupled with fasteners.

3. The saw horse of claim I wherein the side walls and end walls are coupled with an adhesive.

4. The saw horse of claim wherein the enlarged opening is oval shaped.

5. The saw horse of claim 1 wherein the trestle further includes mortise means for retaining the pairs of legs in a generally vertical and outwardly angled orientation in the open position.

6. The saw horse of claim 5 wherein the mortise means includes mortises for maintaining each of the four legs at a first angle with respect to a vertical line from the trestle to a floor surface and for maintaining the pairs of legs at a second angle, splayed away from and along the axis of the length of the trestle, with the vertical line from the trestle to the floor surface.

7. The saw horse of claim 6 wherein the first angle is between about 15 and 40 degrees.

8. The saw horse of claim 6 wherein the first angle is between about 20 and 25 degrees.

9. The saw horse of claim 6 wherein the first angle is about 21 degrees.

10. The saw horse of claim 6 wherein the second angle is between about 5–15 degrees.

11. The saw horse of claim 6 wherein the second angle is between about 8–10 degrees.

12. The saw horse of claim 6 wherein the second angle is about 9 degrees.

13. The saw horse of claim 1 further including foldable locking brace means coupled to each of the pairs of legs for improving the stability of the saw horse.

14. The saw horse of claim 1 further including handle means coupled to the side walls for carrying the saw horse in the closed position.

15. The saw horse of claim 1 further including spring means for biasing the pairs of legs toward its opposite side walls of the trestle when the legs are in the closed position.

16. The saw horse of claim 15 wherein the spring means includes a first spring member on the first rod between one of the side walls and one of the pairs of legs and a second spring member on the second rod between the other side wall and the other pair of legs.

17. The saw horse of claim 1 wherein the first and second operating surfaces are plane surfaces with a third angle between the first and second operating surfaces.

18. The saw horse of claim 17 wherein the third angle is between about 70 and 100 degrees.

19. The saw horse of claim 17 wherein the third angle is between about 85–95 degrees.

20. The saw horse of claim 17 wherein the third angle is about 90 degrees.

21. A saw horse assembly, comprising:

two saw horses each saw horse including:

a trestle, including a substantially flat surface for supporting weight and a downwardly opening box formed with two side walls, running substantially the entire length of the trestle and two end walls connecting the side walls;

two pairs of legs adapted to rotate from a closed position in which each of the legs is contained within the box formed by the trestle and an open position where each of the legs is in a generally vertical orientation, each leg having an enlarged opening proximate its upper end in the open position, a support surface at its lower end in the open position and first, second and third working surfaces for leveling the pairs of legs, stably supporting weight on the trestle and enabling rotation of the legs about the enlarged opening from the closed position to the open position and vice versa, respectively;

a first rod coupled between the side walls proximate a first end wall and extending through the openings in both legs forming one of the pairs of the legs; and a second rod coupled between the side walls proximate the second end wall and extending through the openings in both legs forming the second of the pairs of legs; of legs being in contact with the first operating surface of the other leg of its pair and the second surfaces of each leg of a pair being in contact with the underside of the top surface of the trestle when the sawhorse is in the open position;

whereby exerting pressure on the top surface of the trestle causes sliding adjustment of the first operating surfaces of each pair to level the trestle and stably support the saw horse on uneven surfaces; and coupling means for coupling the saw horses together with the downwardly opening boxes facing each other.

22. The saw horse assembly of claim 21 further including handle means coupled to each of the saw horses for transporting the saw horse assembly.

23. The saw horse assembly of claim 21 wherein the handle means include straps coupled to the respective side walls of each of the saw horses.

* * * * *